United States Patent [19]

McMillin

[11] Patent Number: 4,606,215

[45] Date of Patent: Aug. 19, 1986

[54] APPARATUS AND METHOD FOR STRIPPING WORKPIECES

[75] Inventor: Danny L. McMillin, Arvada, Colo.

[73] Assignee: PAC International, Inc., Arvada, Colo.

[21] Appl. No.: 753,032

[22] Filed: Jul. 8, 1985

[51] Int. Cl.[4] ..... B21D 45/00

[52] U.S. Cl. ..... 72/344; 72/345; 72/349

[58] Field of Search ..... 72/347–349, 72/344, 340

[56] References Cited

U.S. PATENT DOCUMENTS

| | | | |
|---|---|---|---|
| 3,990,289 | 11/1976 | Widmann et al. | 72/345 |
| 4,121,447 | 10/1978 | Sniady | 72/344 |
| 4,148,208 | 4/1979 | Maeder | 72/349 |
| 4,224,819 | 9/1980 | Kauraskas | 72/349 |
| 4,324,124 | 4/1982 | Maeder | 72/349 |

*Primary Examiner*—Leon Gilden

*Attorney, Agent, or Firm*—Klaas & Law

[57] ABSTRACT

Stripping a workpiece from a punch using a plurality of pivotally mounted segments that in an open position have a diameter greater than the outside diameters of the workpiece and the punch but in a closed position have a diameter greater than the outside diameter of the punch but less than the outside diameter of the workpiece.

22 Claims, 13 Drawing Figures

APPARATUS AND METHOD FOR STRIPPING WORKPIECES

FIELD OF THE INVENTION

This invention relates to apparatus and method for stripping a cylindrical workpiece from a cylindrical forming member, and, more particularly, to stripping apparatus employed in a one-piece can drawn and iron type body making machine for stripping a one-piece can body from a punch member.

BACKGROUND OF THE INVENTION

Conventional can body making machines employ a removable tool pack assembly and a removable stripper assembly which are removably mounted in a forming cavity in the machine as generally shown and described in U.S. Pat. Nos. 3,167,044; 3,289,453; 3,312,097; 3,314,274; 3,353,394; 3,359,775; 3,379,153; 3,390,565; 3,399,558; 3,457,766; and 3,469,432. Conventional stripper assemblies comprise annular ring support structure mounting a plurality of separate circumferentially spaced gripping finger members mounted in side by side abutting arrangement in a circular array. The gripping finger members are individually radially inwardly and outwardly displaceable by force of engagement with either the punch member during retraction of the punch after a forming stroke or the can body member on the punch member during the forward forming stroke. Each gripping finger member is provided with a radially innermost machined and hardened edge along which contact is made with the punch or the can. The finger members are held in position by O-ring or garter spring type resiliently deflectable devices which exert a force causing the finger members to be biased toward a radially innermost location defining a more or less circular opening having a diameter less than the outside diameter of the punch and the outside diameter of the can body. These devices also enable the finger members to be radially outwardly displaced to accommodate passage of the punch and the can body through the opening. When the can body on the punch is pushed through the opening, a portion of the inner edge of each finger member rides on the outer surface of the can body until the rim of the can body has passed beyond the inner edges. Then the finger members are moved radially inwardly by the resiliently deflectable devices to cause engagement with the outer peripheral surface of the punch. When the punch is retracted, the finger members engage the end of the can body to prevent rearward movement thereof with the punch. At the same time, compressed air applied through an axial passage in the punch blows the can body away from finger members.

The engagement of the finger members with the can body and the punch causes wear of the finger members, the outer surface of the can body and the outer surface of the punch. The finger members and the punches may be repaired by machining when the amount of wear causes manufacturing problems. The machining causes a reduction in diameter of the punch and an increase in the diameter of the opening formed by the finger members. When the difference between the diameter of the punch and the diameter of the opening reaches a certain amount, the stripping apparatus is no longer operative and the finger members and/or the punch must be replaced. The foregoing problems have led to the practice of keeping a large supply of sets of variable diameter finger members and variable diameter punches so that different diameter combinations of sets of finger members and punches may be employed to obtain a minimum diameter differential suitable for satisfactory manufacturing operations. Even so, at some point in time, the worn finger members and the worn punches must be discarded and replaced with new finger members and new punches. The repair and replacement of finger members and punches constitutes a substantial cost of manufacture.

SUMMARY OF THE INVENTION

The present invention provides a solution to the foregoing problems by eliminating contact between the finger members and the outer peripheral surfaces of both the can body and the punch. The finger members are biased toward a radially outermost retracted position defining an opening of larger diameter than either the can body or the punch. A compressed air operated actuating means is associated with the finger members to exert a force only at the end of the punch stroke causing radial inward movement of the finger members toward the punch to locate the edge portions of the finger members radially inwardly beyond the end of the can body without engagement with the outer peripheral surface of the punch but capable of contacting a surface of the can body to prevent relative movement between the can body and the finger member. The finger members are mounted in a manner providing very accurate positioning and defining a punch-can body opening which is concentric with the punch and the can body. When compressed air is removed from the actuating means during retraction of the punch, a resiliently compressible spring means associated with the finger members causes radial outward movement to the maximum diameter opening position. In addition, opening diameter adjustment means are associated with the finger members to enable the opening diameter to be adjusted.

Additional objects, advantages, and novel features of the invention are set forth in part in the description which follows which will be understood by those skilled in the art upon examination of the following or may be learned by practice of the invention. The objects and advantages of the invention may be realized and obtained by means of the instrumentalities and combinations particularly pointed out in the appended claims.

DETAILED DESCRIPTION OF THE INVENTION

Figure 1:
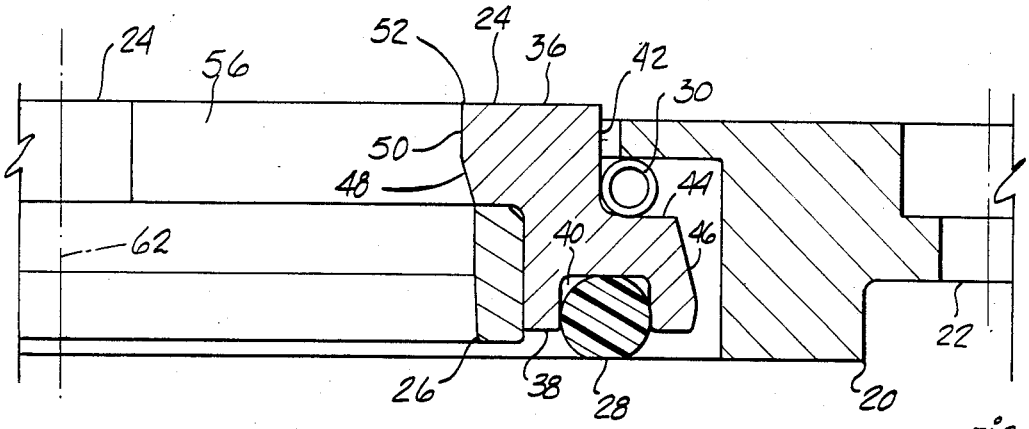
FIG. 1 PRIOR ART
FIG. 1 is a partial cross-sectional side elevational view of a conventional stripper assembly.
Figure 2:
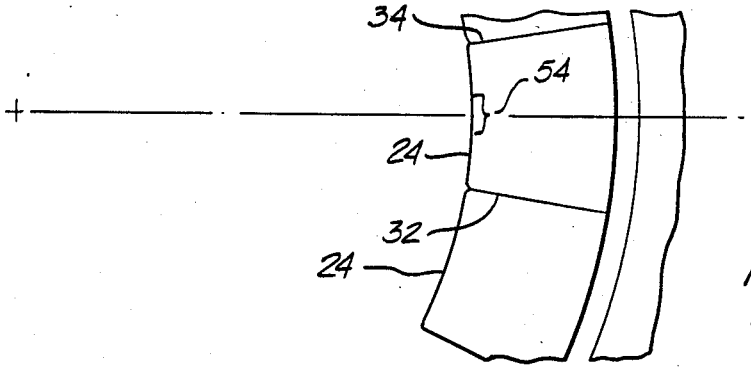
FIG. 2. PRIOR ART
FIG. 2 is a partial end view of the stripper assembly of FIG. 1.

FIGS. 1 and 2 illustrate a conventional prior art stripper assembly comprising an outer retainer ring member 20 having a plurality of circumferentially spaced bolt holes 22 for attachment to a can body maker machine (not shown). A plurality of circumferentially spaced finger gripping segment members 24 are mounted about the inner periphery of retainer member 20 by an annular inner ring member 26, an annular resilient O-ring member 28 and an annular resilient garter-type wire spring member 30.

Each segment member 24 has inclined flat radially extending side surfaces 32, 34 which abut similar side surfaces of circumferentially adjacent segment members. Opposite end surfaces 36, 38 are flat with an annular O-ring groove 40 formed in surface 38. The outer surface of each segment comprises an axially extending side surface 42 connected to a radially extending surface 44 to provide a seat for the garter spring 30, and an inclined side surface 46. The radially innermost portion of each segment is provided with a pair of generally arcuate intersecting inclined surfaces 48, 50. Surface 50 intersects surface 36 at an angle to provide a generally arcuate edge 52. During the course of manufacture of the segments, the original radius of each arcuate edge 52 is slightly changed so that a central portion 54 of each arcuate edge is located further radially inwardly than any other portion. The central radially innermost portions of each segment edge define a generally circular opening 56 having a diameter less than the diameter of an annular punch member 58 and a can body member 60 which pass through the opening during reciprocable operation of the punch between a retracted position and an extended position. It is intended that the central axis 62 of opening 56 be concentrically aligned with the longitudinal axis of the punch and the can body carried thereon, but in practice, the desired condition of concentricity is difficult to achieve and to maintain during continuous high speed operation.

Figure 3:
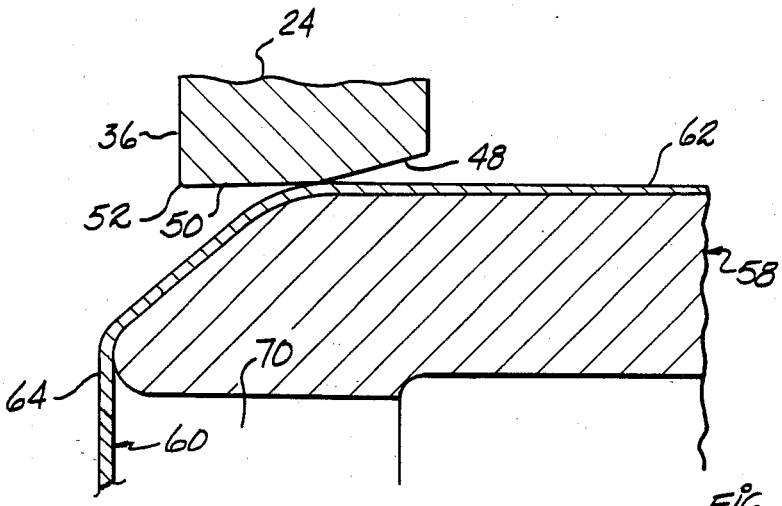
FIG. 3. PRIOR ART
FIG. 3 is a partial cross-sectional side elevational view of a portion of a conventional punch and a portion of a conventional can body showing initial engagement with a stripper finger segment.
Figure 4:
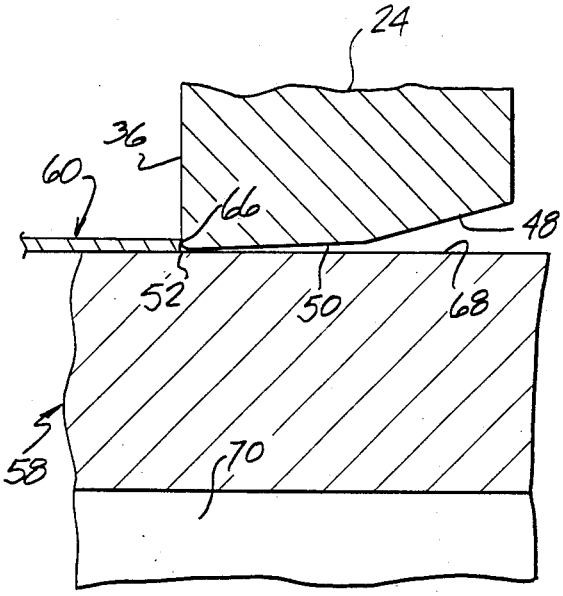
FIG. 4 PRIOR ART
FIG. 4 is a partial cross-sectional side elevational view of the apparatus of FIG. 3 at the end of the punch stroke.
Figure 5:
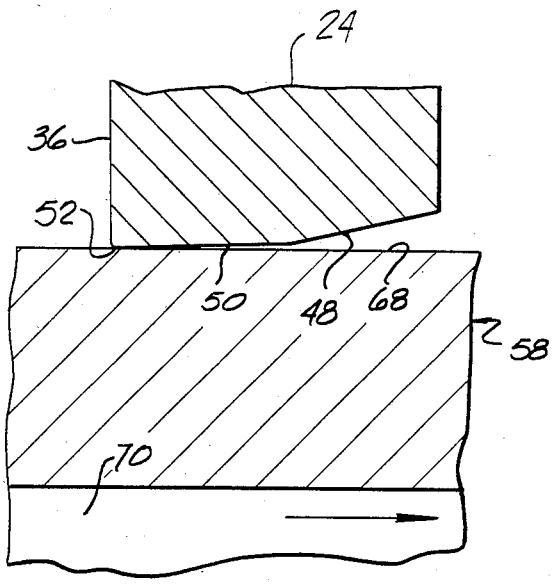
FIG. 5 PRIOR ART
FIG. 5 is a partial cross-sectional view of the apparatus of FIG. 3 during the return stroke of the punch.

In operation, the segments are normally floatably resiliently deflectably supported by O-ring 28 and garter spring 30 in a radially innermost location, as shown in FIG. 1, whereat edge portions 52 are located along a circle of lesser diameter than the diameter of either of the punch 58 or the can body 60 which has a cylindrical side wall portion 62, an end wall portion 64 and an open rim portion 66. During the initial portion of the forward stroke of the punch, the can body is formed by passage through dies in a tool pack (not shown) and then engages the segments 56 as illustrated in FIG. 3 during a subsequent portion of the punch stroke to force the segments radially outwardly away from the can body. When the can body passes beyond the segments, the segments move radially inwardly into engagement with the peripheral surface 68 of the punch as shown in FIG. 4. During the return stroke of the punch, the segment side surfaces 36 engage can rim surface 66 to prevent return movement of the can while compressed air is blown into the open end of the can body through a passage 70 in the punch. As shown in FIG. 5, the segments remain in engagement with the punch during the entire return stroke.

Figure 6:
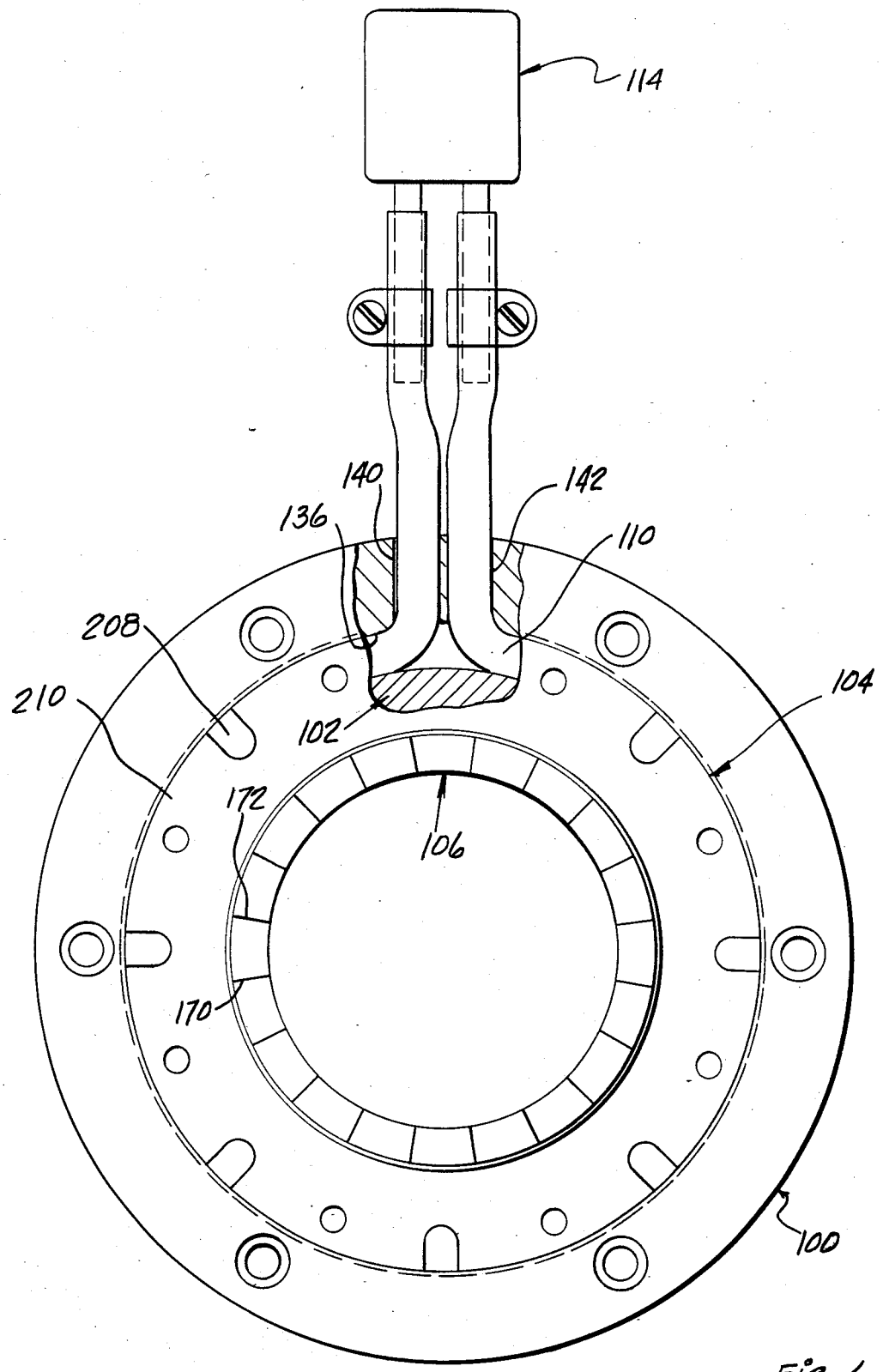
FIG. 6 is an end view, partially in cross-section, of one embodiment of a stripper assembly employing the present invention.
Figure 7:
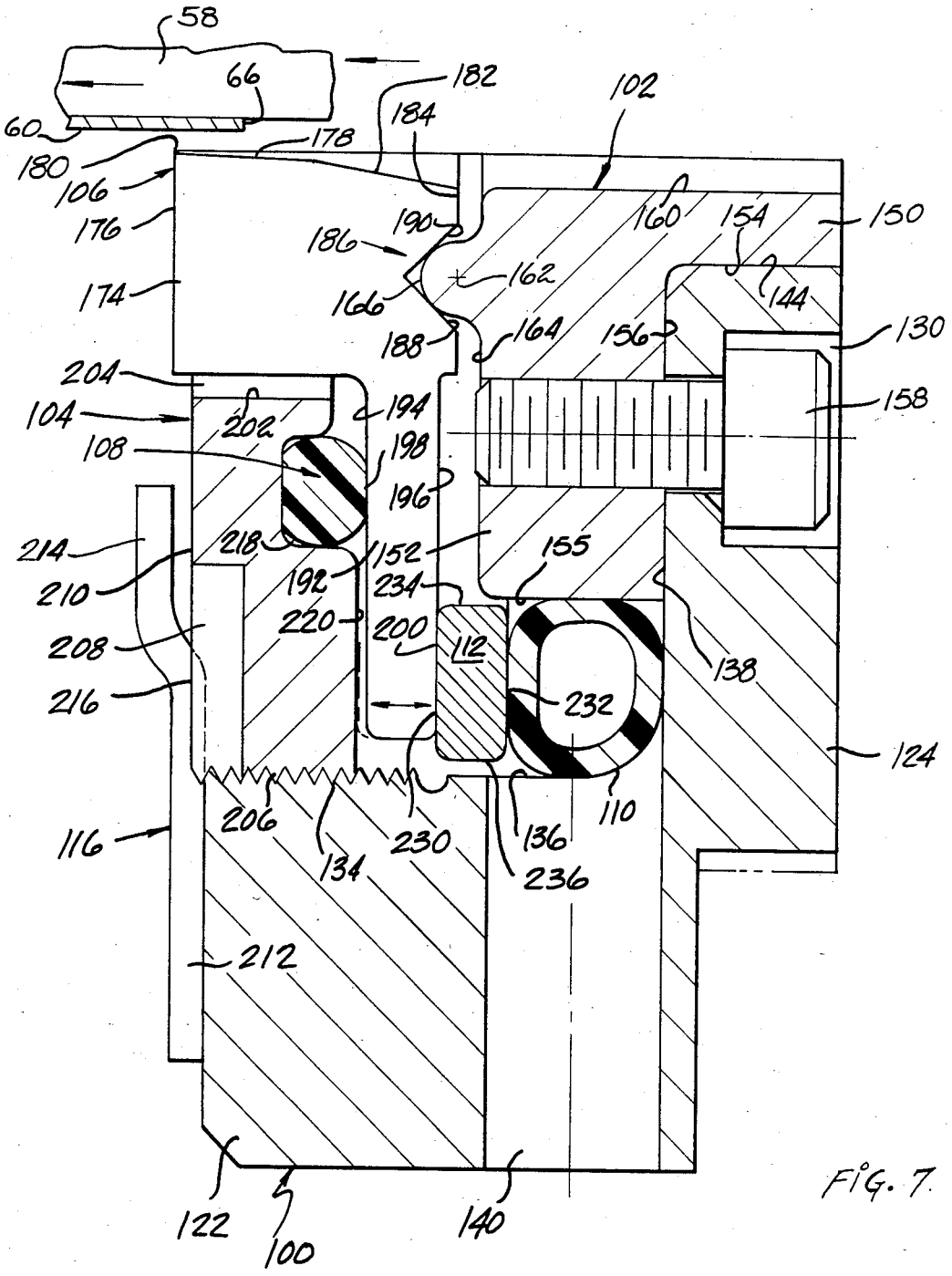
FIG. 7 is an enlarged cross-sectional side elevational view of a portion of the apparatus of FIG. 6.

Referring now to FIGS. 6 and 7, one embodiment of the present invention comprises annular outer housing ring means 100, an inner annular pivot ring means 102, an inner annular adjustment retainer ring means 104, a plurality of circumferentially spaced finger segment means 106, an annular O-ring type flexible resilient biasing ring means 108, an annular air expandable and contractable resilient actuating tube means 110, an annular force transfer ring means 112, an air supply means 114 and an adjustment locking means 116.

Figure 9:
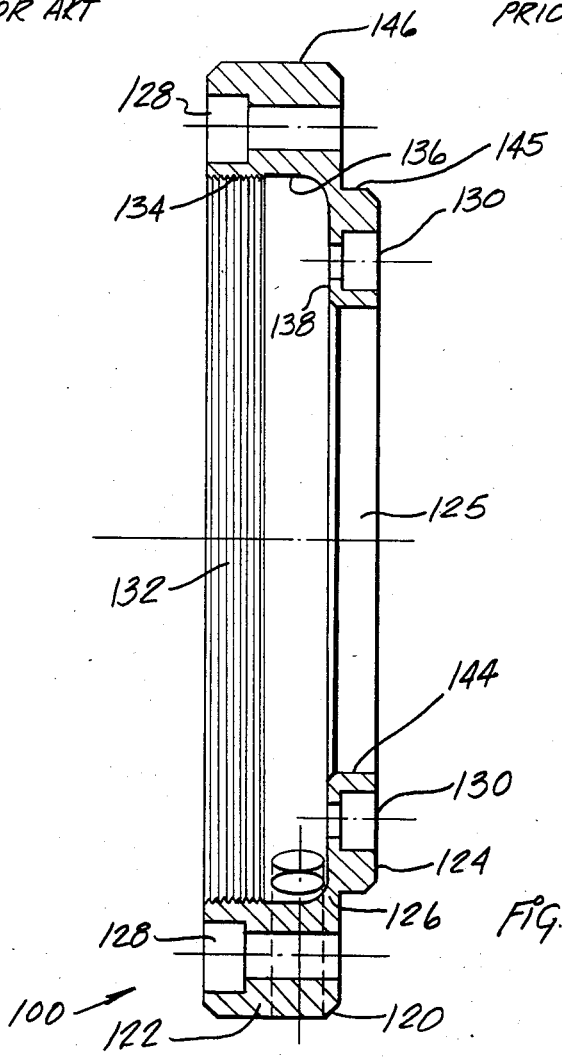
FIG. 9 is a cross-sectional view of the housing means.
Figure 8:
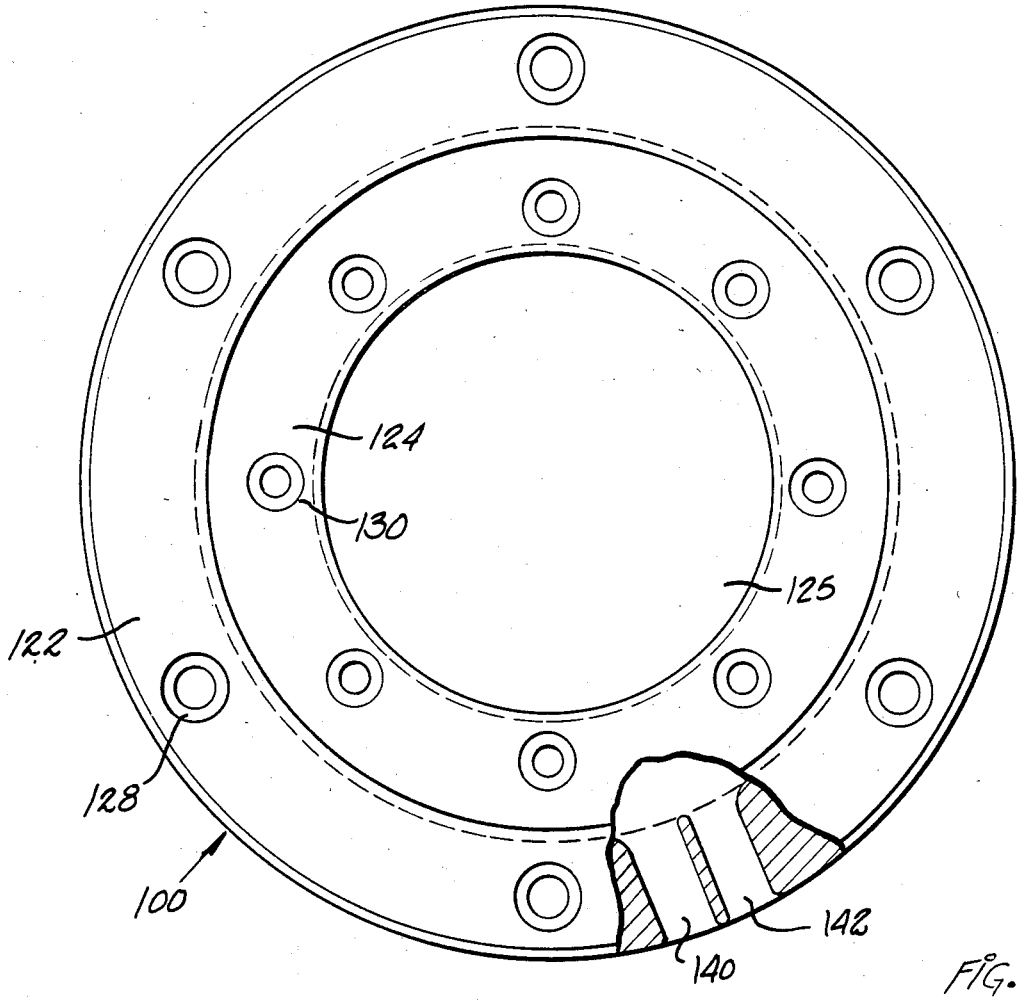
FIG. 8 is an end view, partially in section, of the outer housing means.

As shown in FIGS. 8 and 9, outer retainer ring means 100 comprises an annular ring member 120 made of one-piece of suitable machined steel material with an annular outermost wall portion 122 connected to a side wall portion 124 having a central opening 125 defined by a flange portion 126. A plurality of circumferentially spaced bolt holes 128, 130 are provided in portions 122, 124, respectively. Portions 122, 124 and 126 define an annular cavity 132 having a threaded inner surface portion 134 axially adjacent a flat annular inner abutment surface portion 136 and a radially inwardly extending side abutment surface portion 138. A pair of tube passages 140, 142 extend through portion 122 opposite surface 136. Side surfaces 144, 145, 146 are accurately machined.

Referring to FIG. 7, pivot ring means 102 comprises a radially innermost axially extending annular flange portion 150 and a radially outwardly extending flange portion 152 having accurately machined side surfaces 154, 156 which are held in abutting engagement with retainer ring side surfaces 138, 144 by a plurality of circumferentially spaced bolt members 158. Annular inner peripheral surface 160 has a diameter substantially greater than the diameter of either the can body or the punch. An annular rib portion 162 extends axially outwardly from side surface 164 and has an accurately machined finished semi-circular peripheral surface 166 providing pivotal support means for each of the segments.

Each of the segment means 106, FIG. 6 and 7, has opposite inclined side surfaces 170, 172 to enable abutting supporting engagement with circumferentially adjacent ones of the segment means. A radially innermost head portion 174 has a flat side surface 176, which intersects an inclined inner peripheral annular surface 178 to provide an edge portion 180. A second inclined inner peripheral annular surface 182 intersects a side surface 184 opposite pivot ring surface 160. A V-shape groove 186 having machine finished side surfaces 188, 190 is formed in side surface 184 for rocking pivotal engagement with pivot rib means 162. A radially outwardly extending flange portion 192, having the same width as the head portion, provides spaced oppositely facing flat side surfaces 194, 196 which are continuously engaged by O-ring means 108 and force transfer ring means 112 at radially spaced locations 198, 200.

Adjustable retainer ring means 104 has an inner peripheral surface 202 defining an opening 204 of sufficient diameter to receive the segment head portions 174. The outer peripheral surface 206 is threaded for engagement with threaded portion 134 of outer retainer ring means 100. Thus, the axial location of ring means 104 may be adjustably varied and spanner wrench slots 208 are provided in side surface 210 for that purpose. In order to prevent rotation during operation, outer end portion 212 of locking flange means 116 is suitably fixed to the side by a bolt (not shown) and resiliently deflectable axially offset inner end portion 214 enables a portion 216 to be releasably engaged with one of the spanner wrench slots 208. An annular slot 218 in side surface 220 holds O-ring means 108.

Force applying ring means 112 has flat oppositely facing side surfaces 230, 232 and inner and outer peripheral surfaces 234, 236 such as to provide sufficient clearance. Surfaces 230, 232 are relatively wide to provide maximum contact with the segments 174 and the expandable tube means 110 which is held against surfaces 136, 138 and 155.

In operation, in a pre-adjusted position, as illustrated in FIG. 7, compressed air is injected into the tube means 110 to expand the tube means to cause uniform axial movement of the force ring means 112 and uniform pivotal movement of the segments 106 until side surface 194 abuts side surface 220 whereby all segment edges 180 of all segments are moved equal radial inward distances to define a circle of sufficient diameter to engage only the can end surface 66 during inflation of tube means 110. The distance of pivotal movement of the segments to the extended position is precisely controlled and positively limited by the axial location of surface 220. In order to set the pre-adjusted position of FIG. 7, adjustment ring means 104 is adjusted while tube means 110 is in the expanded condition so as to adjustably vary the diameter of the circle formed by the segment edges 180 when the segments 104 are pivoted about the pivot rib means 162. The adjustment ring means 104 is thus located at a position whereat the diameter of the innermost circle formed by the segment edges 180 is larger than the outside diameter of the punch but smaller than the outside diameter of the can body. Then, adjustment ring means 104 is locked in the pre-adjusted position. Thereafter when the application of the compressed air is stopped, the force of the O-ring bisasing means 108 will cause sufficient reverse uniform pivotal movement of the segments 106 so as to cause radially outward movement of the segment edges 180 to an open position whereat the outermost circle defined by the segment edges 180 is greater than the outside diameter of the can body. The amount of contraction of tube means 110 is exaggerated in FIG. 7 for purposes of illustration. In use in a can body stripping operation, the segment edges 180 will be in the open position of FIG. 7 as the can body 60 and punch 58 are moved through the circle formed by the segment edges 180 with no contact being made by the can body or punch with the segment edges 180. After the edge of the open end of the can body has moved past the circle defined by the segment edges 180, the compressed air will be injected into the tube means 110 to cause pivotal movement of the segments 106, as described above, to the preset closed stripping position whereat surfaces 194 and 220 are in abutting engagement to provide positive stop means so that the segment edges 180 define a circle having a diameter larger than the outside diameter of the punch but smaller than the outside diameter of the can body. Therefore, the segment edges 180 will contact only the edge 66 of the open end of the can body and strip it off the punch as the punch is retracted without engagement with either the peripheral side surface of the can body or the punch.

Figure 10:
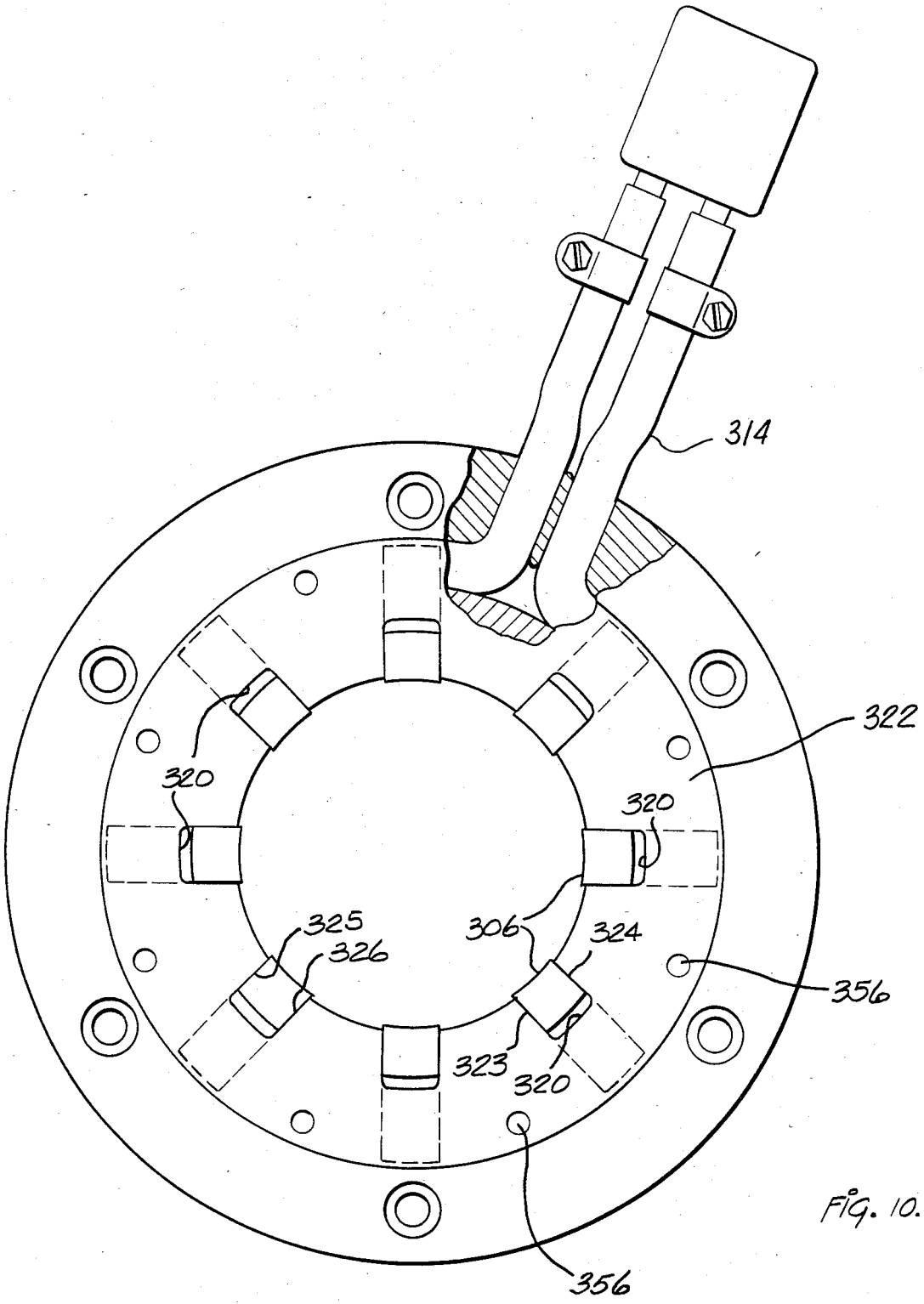
FIG. 10 is an end view, partially in section, of an alternative embodiment.
Figure 11:
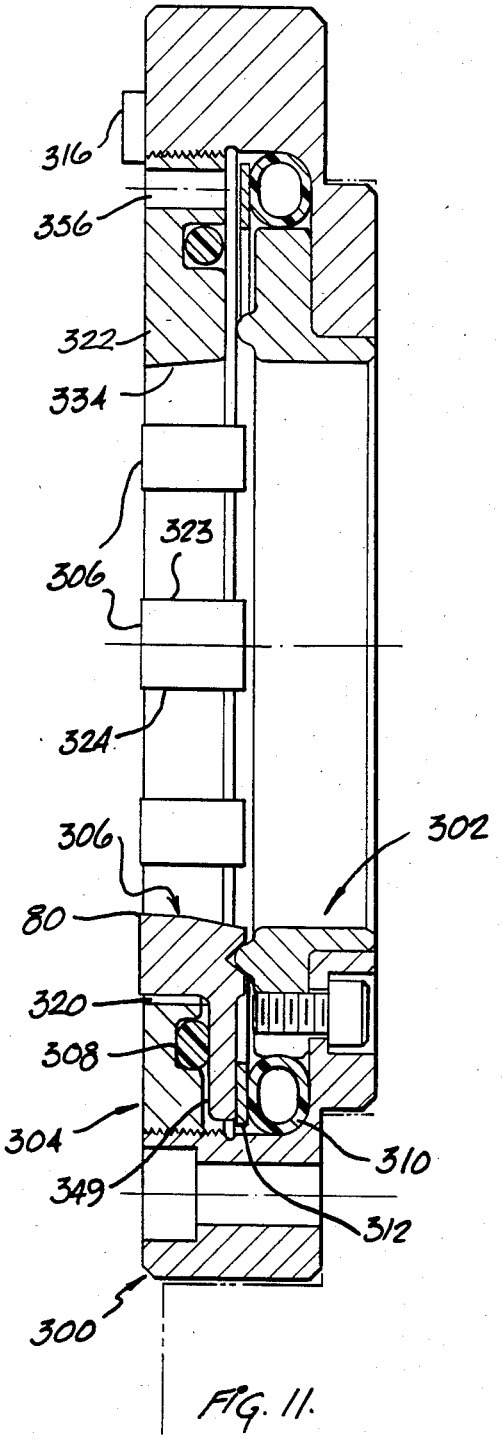
FIG. 11 is an enlarged cross-sectional view of the embodiment of FIG. 10.

FIGS. 10 and 11 show an alternative and presently preferred embodiment of the invention which comprises annular outer housing ring means 300, an inner annular pivot ring means 302, an inner annular adjustment retainer ring means 304, a plurality of circumferentially spaced finger segment means 306, an annular flexible resilient biasing ring means 308, an annular air expandable and contractable resilient actuating tube means 310, an annular force transfer ring means 312, an air supply and control means 314, and an adjustment locking means 316.

The construction, arrangement and operation of the apparatus of FIGS. 10 and 11 is substantially the same as the apparatus of FIGS. 6–9 except as otherwise hereafter described.

Each of the segment means 306 are separately mounted in circumferentially spaced non-contacting relationship in separate circumferentially spaced segment slot means 320 provided in retainer ring member 322. Each segment has an L-shape cross-sectional configuration and comprises a pair of accurately machined and finished opposite parallel axially extending side surfaces 323, 324, which are slidably abuttably supported by accurately machined and finished slot side surfaces 325, 326.

Figure 12:
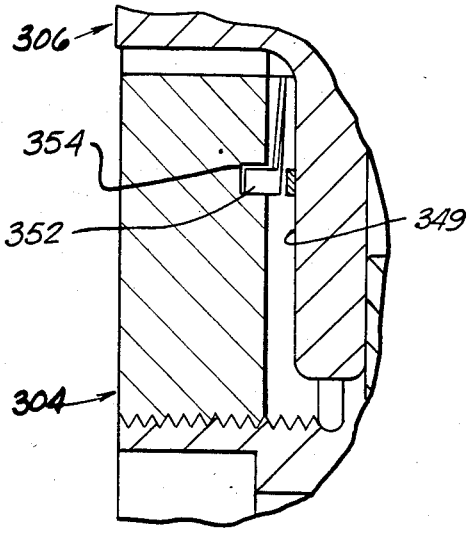
FIG. 12 is a partial cross-sectional view similar to FIG. 11 but using another form of biasing means.
Figure 13:
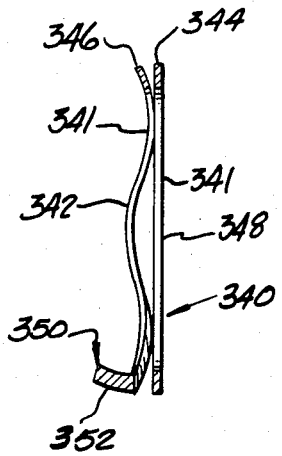
FIG. 13 is a transverse cross-sectional view of the biasing means in FIG. 12.

In another embodiment, surfaces 178, 182 of segment members 106, FIG. 7, may be replaced by a single inclined inner peripheral surface 334 which intersects side surface 176 to provide the radially innermost edge portion 80. In addition, biasing ring means 308 may comprise a one piece metallic wave-type ribbon spring member 340, FIGS. 12 and 13, having circumferentially spaced axially displaced portions 341, 342 on one or more coils 344, 346 with a flat end coil 348 adapted to abut the side surface 349 of segment means 306. End portion 350 of wave form end coil 342 extends axially to provide a tang portion 352 located in a slot 354 in retainer ring member 304 to prevent rotation of spring member 340 and retainer ring member 304 during operation while enabling threaded rotative adjustment of retainer ring member 304 by force applied by a spanner wrench in wrench holes 356.

It is contemplated that the inventive concepts herein described may be variously otherwise embodied and it is intended that the appended claims be construed to include alternative embodiments of the invention except insofar as limited by the prior art.

What is claimed is:

1. Apparatus for stripping a cylindrical workpiece such as a can body member from a cylindrical supporting device such as a punch of a can body making machine comprising:

housing means for supporting the apparatus circumjacent the cylindrical workpiece and the cylindrical supporting device;

a plurality of circumferentially spaced separate finger segment means having separate pivotal axes extending transversely to the path of movement of the workpiece and the supporting device and being separately mounted in said housing means for simultaneous uniform pivotal movement between a retracted radially outwardmost position whereat each of said segment means are continuously radially outwardly spaced from both the workpiece and the supporting device without contact with either of them and an extended radially inwardmost position whereat each of said segment means engage only an end surface of the workpiece without engagement with the supporting device so that axial movement of the supporting device results in disengagement of the workpiece from the supporting device;

actuating means spaced from and located in noncontacting relationship with the workpiece and the supporting device and being operably associated with said segment means for causing pivotal movement thereof about said separate pivotal axes between said retracted position and said extended position and being operable without engagement of said finger segment means with the workpiece and the supporting device; and resilient compressible means for biasing said segment means toward said retracted position and for enabling limited pivotal movement thereof from said retracted position to said extended position.

2. The invention as defined in claim 1 and wherein said actuating means comprises:

expandable and contractable tube means mounted circumjacent the housing means for enabling movement of said segments from the retracted position to the extended position in an expanded state and for enabling movement of said segments from the extended position to the retracted position in a contracted state.

3. The invention as defined in claim 2 and wherein said actuating means further comprises:

a source of compressed air connected to said tube means for supplying compressed air thereto to cause expansion thereof; and exhaust means for exhausting compressed air from said tube means to cause contraction thereof.

4. The invention as defined in claim 3 and further comprising:

resilient compressible means operably associated with said segment means for biasing said segment means toward the retracted position and for causing contraction of said tube means in the absence of compressed air in said tube means.

5. The invention as defined in claim 4 and wherein said resilient compressible means comprises:

an O-ring member.

6. The invention as defined in claim 4 and wherein said resilient compressible means comprises:

a metallic wave spring member.

7. The invention as defined in claim 6 and further comprising:

a force ring member mounted between said tube means and said segment means.

8. The invention as defined in claim 1 and further comprising:

position adjustment means operably associated with said segment means for selectively changing the radial innermost location of said segment means in the extended position.

9. The invention as defined in claim 8 and wherein said position adjustment means comprises:

an annular plate member threadably mounted on said housing means and being operably associated with said segment means whereby axial displacement of said plate member by rotation relative to said housing means limits the amount of movement of said segment means from the retracted position to the extended position.

10. The invention as defined in claim 1 and further comprising:

a pivot ring means fixedly mounted on said housing means and having an annular rib of semi-circular cross-section extending axially therefrom toward said segment means for providing a pivotal support for said segment means; and each of said segment means having a V-shape groove abuttingly receiving a portion of said annular rib and pivotally supporting each of said segment means for enabling uniform equal simultaneous pivotal movement of each of said segment means between the retracted position and the extended position.

11. The method of actuating a plurality of circumferentially spaced stripper segments between a retracted position of non-engagement with a cylindrical workpiece supported on a cylindrical tool member and a position of engagement with the cylindrical workpiece comprising the steps of:

pivotally supporting each of the segments on a common pivotal support member;

holding each of the segments in the retracted position by a first resiliently compressible and expandable ring member on one side of said segments and a second resiliently compressible and expandable ring member on the other side of said segments so that none of the segments contact either the workpiece and/or the tool member; and selectively expanding and contracting one of said resiliently compressible and expandable ring members to cause simultaneous uniform pivotal displacement of each of the segments between the retracted position and the extended position while limiting the degree of pivotal movement from the retracted position to the extended position to prevent contact with the tool member while enabling contact with the workpiece.

12. The method as defined in claim 11 and further comprising:

selectively adjusting the amount of pivotal movement of the segments and the location of the segments in the extended position by varying the state of compression of at least one of the resiliently compressible and expandable ring members in the retracted position of the segments.

13. The method as defined in claim 12 and further comprising:

adjusting the location of the segments in the extended position by axial displacement of a rotatable plate member threadably mounted on a fixed segment support member.

14. Apparatus for stripping a cylindrical workpiece such as a can body member from a cylindrical tool member such as a punch of a can body making machine which is reciprocably movable between a retracted position and extended position by forward and rearward strokes along a fixed stroke axis and includes a passage means connected to a source of compressed air for applying pressurized air to the can body member at the end of the forward stroke and comprising:

an annular housing means fixedly attached to the machine circumjacent the fixed stroke axis and having a central opening defined by internal peripheral surfaces which are concentric with the fixed stroke axis for enabling passage of the workpiece and the tool therethrough;

annular pivot ring means fixedly attached to said housing means circumjacent the stroke axis and having a central opening for enabling passage of the workpiece and the tool therethrough without contact therewith and having at least one external annular peripheral surface which is concentric with the stroke axis and supported by one of said internal peripheral surfaces of said housing means and having annular axially extending rib means of generally semi-circular cross-section which is concentric to the stroke axis for providing a plurality of circumferentially spaced pivot axes tangent to a common circle which is concentric with the stroke axis;

an annular flexibly expandable and contractable tubular means having an annular air passage therein for receiving pressurized air from the compressed air source for selectively causing expansion and contraction of said tubular means and being mounted in said housing means circumjacent said pivot ring means;

an annular force ring means having oppositely facing side surfaces mounted in said housing means in juxtaposition to said tubular means with one of said side surfaces engaging said tubular means for axial displacement thereby during expansion and contraction of said tubular means;

an annular retainer ring means threadably mounted in said housing means on a threaded one of said internal peripheral surfaces and having oppositely facing side surfaces with one side surface being axially spaced from said tubular means and said force ring means to provide an annular space therebetween concentric with the stroke axis and said rib means;

an annular flexibly expandable and contractable resilient ring means mounted in said annular space between said tubular means and said retainer ring means;

a plurality of circumferential spaced segment means mounted in said housing means in an annular array defining a central opening concentric with the stroke axis for enabling passage of the workpiece and the tool therethrough;

each segment means having a radially innermost abutment portion for engaging the workpiece after the forward stroke and a V-shape groove engaging one of said portions of said rib means for enabling pivotal movement of each segment means about said pivotal axes between a radially outwardly retracted position whereat said abutment portion is located along a circle having a diameter larger than the diameter of either of the workpiece and the tool and a radially inwardly extended position whereat said abutment portion is located along a circle concentric to the stroke axis and having a diameter less than the diameter of the workpiece and larger than the diameter of the tool for engagement with a surface of the workpiece without engagement with the tool;

each segment means having a radially outwardly extending flange portion with a pair of oppositely facing side surfaces located in said annular space with one side surface engaging said annular force ring means and the other side surface engaging said resilient ring means for uniformly applying force to each of said segment means whereby each segment is held in the retracted position by force of said resilient ring means in the absence of force of compressed air in said tubular means and is moved to the extended position by application of force of compressed air in said tubular means and is returned to the retracted position by force of said resilient ring means in the absence of force of compressed air in said tubular means; and compressed air supply control means for supplying compressed air to said tubular means from the source of compressed air after the workpiece on the tool has passed through said segment means without contact therebetween on a forward stroke to cause expansion of said tubular means resulting in uniform equal pivotal movement of said segment means to said extended position whereat said abutment means on said segment means engage the end surface of the workpiece without engagement with the tool on the return stroke to cause disassociation of the workpiece from the tool and for disconnecting said tubular means from the source of compressed air and venting the compressed air in said tubular means after the workpiece has been disassociated from the tool on the return stroke whereby force of said resilient ring means is effective to return said segment means from the extended position to the retracted position.

15. The invention as defined in claim 14 and further comprising:

adjustable stop means, including an abutment surface on said annular retainer ring means and abutment surfaces on each of said segment means, for uniformly limiting the amount of pivotal movement of each of said segment means between the retracted position and the extended position.

16. The invention as defined in claim 15 and wherein:

said abutment surface on said annular retainer ring means and said abutment surfaces on each of said segment means are located axially opposite said tubular means.

17. The invention as defined in claim 15 and wherein:

said tubular means is located radially outwardly of said resilient ring means and said pivot ring means is located radially inwardly of said tubular means.

18. The invention as defined in claim 15 and wherein said resilient ring means comprises:

a wave spring member mounted between said one side surface of said retainer ring means and said segment means.

19. The invention as defined in claim 15 and wherein said resilient ring means comprises:

an O-ring member mounted in an annular slot in said one side surface of said retainer ring means.

20. The invention as defined in claim 15 and wherein:

each of said segment means are circumferentially spaced from one another and individually supported in said housing means without contact with one another.

21. The method as defined in claim 12 and wherein said one of the resiliently compressible and expandable ring members is an air inflatable tubular member and comprising the further steps of:

inflating the tubular member by application of compressed air to cause movement of the segments from the retracted position to the extended position; and deflating the tubular member by removal of compressed air to cause movement of the segments from the extended position to the retracted position.

22. The method of claim 21 and comprising the further steps of:

applying compressed air to the tubular member at the end of the forming stroke of the punch so that the segments are in the extended position during the return stroke of the punch; and releasing the compressed air before the next forming stroke of the punch so that the segments are in the retracted position before the next forming stroke of the punch.

* * * * *